United States Patent [19]

Wilkie

[11] 4,384,448

[45] May 24, 1983

[54] RING SPINNING FRAME

[75] Inventor: Arnold E. Wilkie, Pensacola Beach, Fla.

[73] Assignee: Monsanto Company, St. Louis, Mo.

[21] Appl. No.: 203,759

[22] Filed: Nov. 3, 1980

[51] Int. Cl.[3] ..... D01H 5/28; D01H 1/02; D02G 3/00

[52] U.S. Cl. ..... 57/200; 57/252; 57/328; 57/350

[58] Field of Search ..... 57/328–334, 57/350, 200, 252, 255, 256

[56] References Cited

U.S. PATENT DOCUMENTS

| | | | |
|---|---|---|---|
| 2,091,153 | 8/1937 | Martin | 57/329 |
| 2,515,299 | 7/1950 | Foster et al. | 57/333 |
| 2,590,374 | 3/1952 | Brown | 57/336 |
| 2,838,903 | 6/1958 | Sutter | 57/328 |
| 3,079,745 | 3/1963 | Breen et al. | 57/333 |

FOREIGN PATENT DOCUMENTS

| | | |
|---|---|---|
| 1150000 | 1/1958 | France . |
| 674122 | 10/1950 | United Kingdom . |

OTHER PUBLICATIONS

Shimizu et al., "False-Twisting Mechanism of Air-Jet Twister", vol. 31; No. 9, 1975 Journal Society Fibers Science & Technology Japan (JSFSTJ.)

Shimizu et al., "Twist Distribution of Yarns on the Air-Jet False Twister", vol. 32; No. 1, 1976, (JSFSTJ).

*Primary Examiner*—John Petrakes

*Attorney, Agent, or Firm*—John W. Whisler

[57] ABSTRACT

Improvements in conventional ring spinning processes of the type wherein a strand of staple fibers if drafted, twisted and collected on a ring spinning frame are obtained by the added step of subjecting the strand to the twisting action of a pneumatic false twister between the drafting and collecting steps. The added step improves performance and/or permits the process to be operated at higher front roll delivery speeds for any given spindle speed without sacrificing performance. The higher delivery speeds results in improvements in the productivity of the process and the apparent value of staple yarn produced thereby.

9 Claims, 1 Drawing Figure

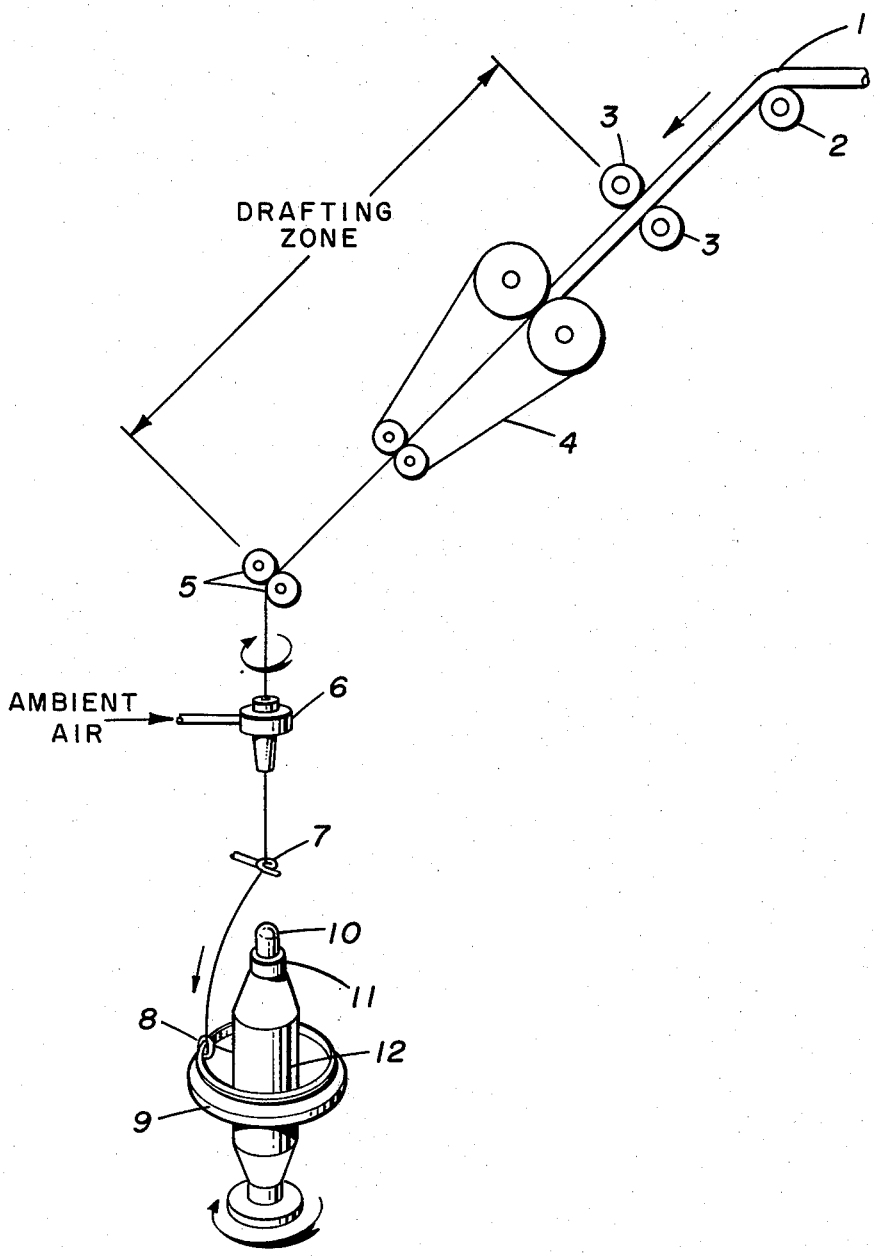
1
2
3
3
DRAFTING ZONE
4
5
6
AMBIENT AIR
7
10
11
8
12
9

RING SPINNING FRAME

BACKGROUND OF THE INVENTION

A. Field of the Invention

This invention relates to improvements in staple spinning processes and, particularly, to improvements in ring spinning processes. The term "strand" when used herein refers to a bundle of staple fibers (natural fibers or lengths cut from filaments) having little or no bundle twist, such as slivers and rovings. The term staple yarn when used herein refers to yarn consisting of staple fibers bound together by twist. In staple spinning processes strands are normally drafted and twisted to provided staple yarns.

B. Description of the Prior Art

In the carpet industry nylon strands (e.g. slivers) are converted to staple yarns on ring spinning frames. A typical frame consists of a plurality of spinning positions each having a drafting system for drafting a strand to a desired count, a rotatable spindle for inserting twist (i.e. spindle twist) in the strand, a pigtail, and a ring-and-traveler take-up mechanism for collecting the twisted strand (staple yarn) on a bobbin mounted on the spindle. The pigtail guide is positioned directly above the centerline of the major axis of the spindle to facilitate collection of the yarn on the bobbin.

Usually, the productivity of spinning frames is maximized by operating the spindles at their maximum mechanically practical speed and then correlating the peripheral speed of the front rolls (delivery speed) to insert just enough spindle twist in the strand to provide twist at the nip of the front rolls. (Increasing the delivery speed reduces spindle twist and causes the twist in the strand to move away from the nip toward the spindle.) In the absence of twist in the strand, individual fibers flare outwardly from the surface of the strand, lick back around the front rolls and pull the strand apart causing breaks or "ends down". With twist in the strand at the nip, breaks usually occur at thin spots in the strand (i.e. imperfections) while the twisted strand is in the balloon and under a relatively high tension (balloon tension). Under normal operating conditions, 30 to 40 ends down per 1000 spindle hours is considered to be acceptable performance.

One disadvantage of operating spinning frames under the conditions described above is that a high level of twist must be inserted in the strand to provide twist in the strand at the nip of the front rolls—much more twist than is needed or even desirable for carpet end use applications, for example, bulked continuous filament (BCF) yarn contains less twist than corresponding staple yarn and, as a result, has more "apparent value", that is, less ounces of BCF yarn are needed per square yard of carpeting to achieve a carpet of the same body.

The twist level of staple yarn can be reduced while still providing twist at the nip of the front rolls by slowing down the spindle speed. However, slowing down the spindle speed, reduces productivity. U.S. Pat. No. 2,590,374 shows inserting a mechanical false twister on a ring spinning frame downstream of the front rolls. With this arrangement it is possible to increase the delivery speed somewhat and reduce the twist level in the yarn while still providing twist at the nip of the front rolls. (The twister inserts twist in the strand which backs up the strand into the nip of the front rolls.) However, as the deliver speed is gradually increased, the frequency of breaks in the balloon increases until, finally, a speed is reached at which the strand lacks sufficient strength to withstand the balloon tension and the process cannot be run. The observed twist inserted in the strand by the mechanical false twister does not pass through the twister into the balloon. Therefore, as the deliver speed is increased and the spindle twist level reduced, the strength of the strand in the balloon is reduced and even slight imperfections in the strand that were masked with twist under normal operating conditions are now a problem with respect to breaks.

SUMMARY OF THE INVENTION

It is an object of the present invention to improve the performance of staple spinning processes and, in particular, of ring spinning processes.

It is a further object of the invention to provide an improvement in staple spinning processes and, in particular, in ring spinning processes, whereby sliver of reduced quality with respect to imperfections can be used without sacrificing performance.

It is another object of the invention to provide an improvement in staple spinning processes and, in particular, in ring spinning processes whereby the twist level of the spun yarn can be reduced without sacrificing productivity or performance.

It is another object of the invention to provide an improvement in staple spinning processes and, in particular ring spinning processes whereby the twist level of the spun yarn can be reduced without sacrificing productivity or performance.

It is yet another object of the invention to improve the productivity of staple spinning processes and, in particular, of ring spinning processes.

It is still another object of the invention to improve the apparent value of staple yarns without sacrificing productivity or performance.

These and other objects and advantages of the invention will be apparent to those skilled in the art from the following detailed description thereof.

The foregoing objects and advantages are accomplished by providing an improvement in staple spinning processes of the type wherein in one continuous operation a strand is forwarded such as by means of a pair of nip rolls, then, twisted while being forwarded by means of a spindle rotating at a given speed and, finally, collected on a bobbin mounted on the spindle by means for receiving and winding the forwarded, twisted strand on the bobbin, such as, a take-up mechanism. The improvement comprises the added step of subjecting the strand as it is being forwarded to the twisting action of a fluid vortex false twisting device (hereinafter referred to as a "fluid false twister"), wherein the twist provided in the strand by said twisting action and the twist inserted in the strand by said spindle are in the same direction. Under steady state conditions the twist provided by the fluid false twister in the moving strand between the forwarding means and the receiving and winding means is a temporary twist that disappears from the strand before it is collected on the bobbin.

Apparatus for accomplishing the improvement and fiber produced thereby are also provided. The apparatus preferably comprises a conventional staple spinning frame to which has been added in the way of an improvement thereto a fluid false twister disposed between the forwarding means (e.g. nip rolls) and winding means (e.g. ring-and-traveler) for providing twist in the strand in the same direction as the rotational direction of the spindle. By "conventional" spinning frame is meant a frame of the type having one or more spinning positions each including: means for forwarding a drafted strand of staple fibers; a rotatable spindle for inserting twist in the drafted strand; means for receiving and winding the drafted and twisted strand onto a bobbin mounted on said spindle and guide means disposed between said nip rolls and said winding means to facilitate winding of the twisted strand onto the bobbin.

The twist level of staple yarn produced in accordance with the improvement of the present invention will depend upon the conditions under which the improvement is operated. According to one aspect of the invention the fluid false twister is used under conditions to improve performance of the spinning process. Under such conditions, the frame is operated at its normal delivery speed and spindle speed and, therefore, the resulting yarn will have the same twist level as yarn produced on an unmodified frame that is, a conventional frame to which the fluid false twister has not been added. According to another aspect of the invention, the fluid false twister is used under conditions to produce low twist yarn while increasing productivity of the frame and achieving acceptable performance. Under such latter conditions, the frame is operated at its normal (maximum practical) spindle speed and its delivery speed is increased an appropriate amount above its normal operating speed to achieve the desired reduced twist level in the yarn. By "low twist" yarn is meant yarn which has a twist level lower than can be produced on an unmodified frame when operating the frame at its normal spindle speed. Normally, the minimum twist level that can be inserted in a strand on an unmodified spinning frame when operating the frame at its normal spindle speed depends on the count and denier of the fibers, for example, a $2\frac{1}{2}$ cotton count, 15 denier per fiber (dpf), nylon 66 staple yarn must have a minimum of about $4\frac{1}{2}$ tpi (177.3 tpm) in order to operate the frame at its normal spindle speed. (Under the same conditions, increasing either the count or dpf of the strand requires that more twist be inserted.) Staple yarns produced in accordance with the invention are characterized in having a relatively large number of surface bundle wraps (i.e. fasciations) per foot of yarn length as compared to correspondingly yarns produced on unmodified frames by slowing down the spindle speed. Normally, the number of fasciations increases with increases in spindle twist and/or pressure of fluid supplied to the fluid twister.

In addition to the above-mentioned advantages, the present invention makes it possible to spin finer yarns and to reduce the number of fibers in the yarn bundle and to improve the overall control of the spinning process and quality of the resulting yarn.

In the spinning process of the present invention, the twisting action to which the strand is subjected by the fluid false twister is fundamentally different from that of the mechanical false twister described in the prior art. In using a fluid false twister, the strand while under an appropriate tension is twisted by a gyration of the strand in the twister in which the strand is caused by fluid jets to whip around the interior of the bore of the twister without contacting the bore walls in "jump rope" fashion. This twisting action imparts twist in the strand such that the twist extends from the nip of the front rolls to the take-up mechanism in only one direction (S or Z). If the tension on the strand is too high, gyration of the strand is not possible. On the other hand, if the tension on the strand is too low, the gyration is too vigorous and the strand tends to wrap around its self. The amount of twist provided in the strand by a fluid false twister during the spinning process can be increased or decreased somewhat, by increasing or decreasing the velocity of the fluid jets. With regard to the distribution of twist provided in the strand, in general, the twist frequency is maximum at the center point of the twister and decreases as one move away from the twister. In contrast, when a mechanical false twister is used instead of a fluid false twister, twist is not provided in the strand between the twister and take-up mechanism. Thus, the fluid false twister, in addition to providing twist in the strand at the nip rolls, also provides twist and therefore strength in the strand in the balloon (below the twister), whereas the mechanical false twister does not.

BRIEF DESCRIPTION OF THE DRAWING

The FIGURE is a schematic representation of a ring spinning frame position to which has been added a pneumatic false twister in accordance with the present invention.

DESCRIPTION OF THE PREFERRED EMBODIMENTS

In accordance with the present invention a fluid false twister is added to one or more positions of a spinning frame, such as, a ring spinning frame, flyer spinning frame or cap spinning frame to provide what is referred to herein as a "improved frame". The improved spinning frames of the present invention may be used to process a strand of staple length fibers such as a roving or sliver to a staple yarn of any desired count. Any strand that can be processed on a conventional frame can be processed on the improved frame of the present invention. Thus, the improved frame may be used to produced staple yarns composed of either natural staple length fibers such as wool and cotton or synthetic fibers such as polyamides (e.g. nylon 6 and 66), polyesters (e.g. PET), acrylics, modacrylics or blends of natural fibers and/or synthetic fibers. Also, the improved frames may be used stead of roving frames to convert sliver to roving.

The improved frames of the present invention may be operated in the same manner as the corresponding unmodified frame, however, higher front roll delivery speeds may be used at any given spindle speed without sacrificing the performance of the frame. Although the improved frames described herein have been operated using a balloon (balloon mode), it is contemplated that the frames, if desired, could be operated in the balloonless mode.

In a preferred embodiment of the invention disclosed in the FIGURE, a pneumatic false twister is added to a conventional ring spinning frame position in accordance with the present invention. Referring to the FIGURE, a spinning position comprised of conventional components (i.e. guide roll 2, a pair of driven nip rolls 3 which serve as feed rolls, an apron drafting system 4 having two pair of driven nip rolls, referred to as middle rolls, a pair of driven nip rolls 5, referred to as front rolls or delivery rolls, a pigtail guide 7, traveler 8, ring 9, and spindle 10) is shown to which a pneumatic false twister 6 has been added between front rolls 5 and traveler 8 in accordance with the present invention. Each pair of nip rolls is driven at a peripheral speed correlated to give the desired drafting and throughput. Normally, twister 6 is placed a short distance downstream from front rolls 5, for example, 5 to 15 cm. However, if desired, twister 6 may be position further downstream. The optimum spacing of twister 6 between nip rolls 5 and traveler 8 for a given set of operating conditions can be easily determined by routine experimentation, for example, by making a series of slight changes in the spacing during operation of the frame until optimum operating conditions are achieved. In operation of the improved frame, strand 1 is fed from a source (not shown), such as a can, to feed rolls 3, through the drafting zone where it is drafted (e.g. 20X) to the desired count in a conventional manner. Most of the drafting occurs in the apron system. Upon leaving the nip of delivery rolls 5, the strand passes downward through twister 6 and guide 7 and is eventually taken up on bobbin 11 mounted on spindle 10 to form package 12 by means of the usual spinning mechanism including ring 9, traveler 8 and spindle 10. Ring 9 moves up and down and traveler 8 moves around ring 9 on a track at a speed which is correlated with the speed of the spindle and the vertical motion of the ring to properly distribute the strand in forming package 12 on bobbin 11. The rotation of traveler 8 around spindle 10 causes the threadline to balloon outwardly from the major axis of the bobbin between traveler 8 and guide 7. With twister 6 in place, pigtail guide 7 is no longer needed because, if guide 7 is removed, the twister will then serve as a pigtail guide. In fact, with twister 6 in place, guide 7 is preferably removed since it tends to impede the progation of twist along the strand. With guide 7 removed, the strand balloons outwardly between traveler 8 and twister 6. Rotating spindle 10 inserts real twist (spindle twist) in the strand which backs up the strand toward the nip of front rolls 5. Twister 6 inserts twist along the length of the strand from the nip of front rolls 5 through the balloon to traveler 8 in a single direction. Twister 6 is operated so that the direction of the twists are the same, whereby the twist provided by twister 6 adds to the spindle twist. The twist provided by twister 6 imparts temporary strength to the strand between front rolls 5 and traveler 8, thereby requiring less spindle twist to keep the strand from breaking. Consequently, twister 6 permits the frame to be operated at higher front roll delivery speed without causing the strand to break than is possible when it is omitted from the frame.

Pneumatic false twisting devices which may be used in practicing the invention are those conventionally used in the art to insert false twist in strands and yarns. Such devices are well-known. Although air is preferably used as the fluid in practicing the invention, other fluids could be used if desired, such as, nitrogen, carbon dioxide, steam and possibly water or the like, to provide special effects or to accomplish other objectives.

As with any ring spinning frame, the maximum delivery speed at which the front rolls of the improved frame of the present invention can be operated while still maintaining acceptable performance depends on factors such as design of frame components, count of the yarn being spun and the like. In general, reducing the count, reduces the amount of twist required to keep the strand from breaking on the frame during processing. When it is desired to change from one count to another, the amount of twist required to keep the strand from breaking at the new count can be calculated using the formula: $TM=T/\sqrt{CC}$; where TM stands for "twist multiplier" and is a constant and the same for all counts, T represents twist in terms of turns per inch (tpi), and cc represents cotton count.

The following examples are given to further illustrate the invention.

EXAMPLE 1

This example demonstrates the advantages of the modified spinning frame of the present invention. In the example spinning runs were carried out using one position of a conventional SKF Spin Tester, 4-position ring spinning frame, in which 75-grain per yard (5.3 grams per meter) sliver composed of nylon 66 staple fibers having a length of 7½ inches (19.05 cm), a denier of 15 and an average of 9 crimps per inch (354 cpm) was converted into 2½ cotton count spun yarn having twist in the Z direction. The ring of the SKF frame had an inside diameter of four inches (10.2 cm). The traveler was a G-81B (heavy). The distance between the front rolls and back rolls (drafting zone) was 8⅜ inches (21.17 cm).

In certain of the spinning runs, the spinning position was modified as shown in the FIGURE to include a pneumatic false twister positioned about three inches (7.62 cm) below the front rolls. In other spinning runs, the pneumatic false twister was replaced with the mechanical false twister described in U.S. Pat. No. 2,590,374. (In this instance the twister utilized a disc having a diameter of 2.54 cm.) In still other spinning runs, the unmodified frame was used, that is, the false twister shown in the FIGURE was omitted.

In each of the runs the spindle was operated at its highest practical speed and the roll speeds were adjusted to provide various twist levels in the final product ranging from 4.5 tpi (177.3 tpm) to 1.0 tpi (39.4 tpm). If the sliver broke before a full doff (about 1 lb. or 453.9 g) was collected, adjustments and/or changes were made (e.g. different sliver stock was used) and the run repeated until a full doff was obtained without a break or until five such attempts had been made. If, after five attempts, a full doff could not be collected without a break in the sliver occurring, the performance was considered unsatisfactory (unsat.). Otherwise, the performance was considered satisfactory (OK). In each run the number of fasciations were determined by removing the spindle twist from a sample of yarn 12 inches (30.48 cm) in length and then counting the number of individual fibers which were wrapped around the surface of the resulting twistless yarn bundle. The results of the runs are given in Table I.

TABLE I

| | RUN | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Rolls - Peripheral Speed | | | | | | | | | | | | | | |
| back - fpm | 8 | 5.5 | 6.5 | → | → | 7.5 | → | → | 7.5 | → | → | 8.5 | → | → |
| mpm | 2.4 | 1.7 | 2.0 | → | → | 2.3 | → | → | 2.3 | → | → | 2.6 | → | → |
| middle - fpm | 12 | 9.5 | 10.5 | → | → | 11.5 | → | → | 12.5 | → | → | 13.5 | → | → |
| mpm | 3.7 | 2.9 | 3.2 | → | → | 3.5 | → | → | 3.8 | → | → | 4.1 | → | → |
| front - fpm | 97 | 135 | 158 | → | → | 171 | → | → | 185 | → | → | 200 | → | → |
| mpm | 29.6 | 41.1 | 48.2 | → | → | 52.1 | → | → | 56.4 | → | → | 61.0 | → | → |

TABLE I-continued

| | | | | | | | | | | | | | | |
|---|---|---|---|---|---|---|---|---|---|---|---|---|---|---|
| Spindle speed - rpm | 5500 | → | → | → | → | → | → | → | → | → | → | → | → | → |
| False Twister Used | | | | | | | | | | | | | | |
| none/air/mech. | none | none | none | mech | air | none | mech | air | none | mech | air | none | mech | air |
| air - psig/KPa | none | none | none | none | 30/308 | none | none | 30/308 | none | none | 30/308 | none | none | 50/446 |
| mech - rpm of disc | none | none | none | 4300 | none | none | 4300 | none | none | 4300 | none | none | 7500 | none |
| Twist in Product - tpi | 4.5 | 3.5 | 3.0 | → | → | 2.7 | → | → | 2.5 | → | → | 2.3 | → | → |
| tpm | 177.2 | 137.8 | 118.1 | → | → | 106.3 | → | → | 98.4 | → | → | 90.6 | → | → |
| Fasciations per foot | 8.4 | 2.3 | → | 1.0 | 4.0 | → | 1.0 | 4.0 | → | 1.8 | 3.6 | → | 0.7 | 3.9 |
| meter | 27.6 | 7.6 | → | 3.3 | 13.1 | → | 3.3 | 13.1 | → | 5.9 | 11.8 | → | 2.3 | 12.8 |
| Performance | OK | OK | Unsat. | OK | OK | Unsat. | OK | OK | Unsat. | OK | OK | Unsat. | OK | OK |

| | RUN | | | | | | | | | | | |
|---|---|---|---|---|---|---|---|---|---|---|---|---|
| | 15 | 16 | 17 | 18 | 19 | 20 | 21 | 22 | 23 | 24 | 25 | 26 |
| Rolls - Peripheral Speed | | | | | | | | | | | | |
| back - fpm | 10.5 | → | → | 14.5 | → | → | 15.5 | → | → | 17.5 | → | → |
| mpm | 3.2 | → | → | 23.5 | → | → | 25.5 | → | → | 27.5 | → | → |
| middle - fpm | 16.5 | → | → | 23.5 | → | → | 25.5 | → | → | 27.5 | → | → |
| mpm | 5.0 | → | → | 7.2 | → | → | 7.8 | → | → | 8.4 | → | → |
| front - fpm | 243 | → | → | 349 | → | → | 375 | → | → | 398 | → | → |
| mpm | 74.1 | → | → | 106.4 | → | → | 114.3 | → | → | 121.3 | → | → |
| Spindle Speed - rpm | → | → | → | 5900 | → | → | → | → | → | → | → | → |
| False Twister Used | | | | | | | | | | | | |
| none/air/mech. | none | mech | air | none | mech | air | none | mech | air | none | mech | air |
| air - psig/KPa | none | none | 65/546 | none | none | 75/616 | none | none | 75/616 | none | none | 80/651 |
| mech - rpm of disc | none | 10,000 | none | none | 10,000 | none | none | 10,000 | none | none | 10,000 | none |
| Twist in Product - tpi | 1.9 | → | → | 1.4 | → | → | 1.2 | → | → | 1.0 | → | → |
| tpm | 74.8 | → | → | 55.1 | → | → | 47.2 | → | → | 39.4 | → | → |
| Fasciations per foot | → | → | 4.9 | → | → | 7.9 | → | → | 14.9 | → | → | 14.9 |
| meter | → | → | 16.1 | → | → | 25.9 | → | → | 48.9 | → | → | 48.9 |
| Performance | Unsat. | Unsat. | OK | Unsat. | Unsat. | OK | Unsat. | Unsat. | OK | Unsat. | Unsat. | OK |

The results given in the table show that the improved frame of the present invention can be successfully operated at much higher front roll delivery speeds and therefore at a higher productivity than when the pneumatic twister is omitted from the frame or the mechanical false twister is substituted therefor.

EXAMPLE 2

Test were conducted whereby twist inserted into a threadline by the false twisters described in Example 1 was observed. In the tests, ring spinning conditions were simulated by passing a yarn between two pairs of vertically spaced nip rolls. The twister was positioned about 7.62 cm. below the upper pair of rolls. The distance between the upper and lower pair of nip rolls corresponded approximately to the distance between the front rolls and traveler on the SKF spinning frame position described in Example 1, i.e., about 1 m. The yarn was composed of two parallel bundles (zero ply twist) of continuous nylon 66 filaments, one white bundle and one black bundle. The bundles when fed into the nip of the upper pair of rolls were either touching one another or in close proximity to one another. The peripheral speed of the lower pair of rolls was maintained slightly faster than that of the upper rolls so as to keep the bundles taut. No effort was made to collect the bundles after they passed through the nip of the lower rolls. With this arrangement, it was possible with a stroboscope to easily observe the presence and direction (S or Z) of twist inserted into the yarn by the twist under both dynamic (moving yarn) and static (stationary) yarn conditions. (The contrasting black and white strand greatly assisted in determining the direction and frequency of the twist.)

In a first set of tests, the test apparatus included the pneumatic false twister used in Example 1. Then, in a second set of tests, the pneumatic twister was replaced with the mechanical false twister used in Example 1. In each set of tests the presence and direction of twist inserted in the yarn or the absence thereof both upstream and downstream of the centerline of the twister and under both static and dynamic conditions were observed with the aid of a stroboscope. The results of the tests are given in Table II.

TABLE II

| | TWIST DIRECTION | | | |
|---|---|---|---|---|
| | STATIC | | DYNAMIC | |
| Twister | Upstream | Downstream | Upstream | Downstream |
| Pneumatic | Z | S | Z | Z |
| Mech. | Z | S | Z | No Twist |

It was not only surprising to discover that the pneumatic twister provided twist in the moving yarn downstream of the twister, but it was also surprising to discover that the twist downstream of the twister was in the same direction as the twist upstream of the twister It was observed that in the moving yarn the twist downstream of the pneumatic false twister diminished in frequency along the length of the yarn until it reached the bottom nip rolls at which point there was zero twist in the yarn.

In accordance with the present invention, the twist provided in the moving threadline downstream of the pneumatic twister adds to the spindle twist, thereby enabling the frame at any given spindle speed to be operated at higher front roll deliver speeds and lower spindle twist levels (higher productivity and lower twist levels) without causing the yarn to break in the balloon than is possible if the pneumatic twister is omitted or a mechanical twister is substituted therefor.

EXAMPLE 3

In this example, two ends of the yarn produced as described in Run 5 of Example 1 were plied on a conventional ring twister to provide a 3 tpi (118.2 tpm) Z-twist×3 tpi S-twist (net twist of 0 tpi twist×3 tpi S-twist) yarn. Also, two ends of the yarn produced as described in Run 1 (conventional yarn) were similarly plied to provide a 4½ tpi (177.3 tpm) Z-twist×3 tpi S-twist (net twist of 1½ tpi Z-twist×3 tpi S-twist) yarn. Cut pile carpets were made from each of the yarns. Both carpets retained very good appearance after being subjected to 12,000 traffics in Decatur, Ala. High School. In walking on a carpet, a traffic occurs each time the right foot touches or contacts the carpeting. The advantage of the 3 tpi Z-twist×3 tpi S-twist yarn is that it has a slightly higher bulk and was plied from yarn produced at a higher level of productivity. It was observed that the carpet made from the low twist yarn of the present invention appeared to have more body (i.e. 1½ oz./yd$^2$ or 50.9 g/m$^2$) and, therefore, more apparent value.

EXAMPLE 4

Two ends of the yarn produced in Run 17 were plied on a Verdol direct cabler to provide a plied yarn having a net twist of 1.9 tpi (74.8 tpm) Z-twist in the singles and 3.3 tpi (130 tpm) S-twist in the ply. Similarly, a plied yarn having a net twist of 1.3 tpi (55 tpm) Z-twist in the singles and 3.3 tpi S-twist in the ply was formed from two ends of the yarn produced in Run 20 of Example 1. The advantage of these yarns over conventional yarns is that conventional yarns cannot be processed on direct cablers because they are too highly twisted. (In cabling operations twist is not removed from the singles yarns as in plying operations.)

EXAMPLE 5

Using all 4 positions of the SKF Spin Tester ring spinning frame described in Example 1 two runs were made. In each run the frame was continuously operated for about 13 hours (50 spindle hours) during which time a 75-grain per yard (5.3 grams per meter) sliver identical to that described in Example 1 was processed under the conditions specified in Table III. In Run I a pneumatic false twister was added to the frame in accordance with the present invention as described in Example 1 and the frame was operated to provide 2½ cotton count yarn having 3.0 tpi (118.2 tpm) twist. In Run II, for purposes of comparison, the twister was omitted and the frame operated at conventional speeds to provide a 2½ cotton count yarn having 5.0 tpi (200 tpm) twist. No breaks occurred during Run II and only one break occurred during Run I, which break was determined to be related to a sliver defect and not to the operation of the frame.

TABLE III

| | | Run I | Run II |
|---|---|---|---|
| False Twist | | yes | none |
| Twist in Product | - tpi | 3.0 | 5.0 |
| | - tpm | 120 | 200 |
| Peripheral Speed of Rolls | | | |
| Back Rolls | - fpm | 7.0 | 4.5 |
| | - mpm | 2.2 | 1.8 |
| Middle Rolls | - fpm | 11.0 | 6.0 |
| | - mpm | 3.4 | 1.8 |
| Front Rolls | - rpm | 158 | 98 |

TABLE III-continued

| | | Run I | Run II |
|---|---|---|---|
| | - mpm | 48.2 | 29.9 |
| Spindle Speed | - rpm | 5900 | 5700 |

The results of the runs demonstrate that the production of a conventional ring spinning is improved in accordance with the present invention without sacrificing performance.

When a pneumatic false twister is added to a spinning frame position in accordance with the present invention (e.g. the arrangement used in Run I) and the frame operated under conventional conditions (e.g. the conditions used in Run II), the performance of the frame is improved without sacrificing productivity.

What I claim is:

1. In a ring spinning process wherein a strand of staple fibers is drafted to a desired count, forwarded by means of a pair of nip rolls, twisted while being forwarded by means of a rotating spindle, and collected on a bobbin mounted on said spindle by means of a ring-and-traveler take-up mechanism, the improvement comprising in combination (a) the added step of subjecting said strand as it is being forwarded to the twisting action of a pneumatic false twister, wherein the temporary twist inserted in the strand by said twisting action and the twist inserted in the strand by said spindle are in the same direction, and (b) forwarding the strand at a higher speed than is possible if said additional step were omitted, whereby the productivity of the process is increased and the twist level of the strand produced by the process is reduced.

2. The process of claim 1 wherein said fibers are composed of nylon.

3. The process of claim 2 wherein said nylon is nylon 66.

4. The product produced by the process of claim 1.

5. The product of claim 4 wherein said fibers are composed of nylon.

6. The product of claim 5 wherein said fibers are composed of nylon 66.

7. In a ring spinning frame position of the type comprising: means for drafting a strand of staple fibers to a desired count, said means including a pair of nip rolls for forwarding said strand from said drafting means; a ring-and-traveler take-up mechanism for receiving said strand and winding said strand onto a bobbin mounted on a rotatable spindle, said spindle being adapted to insert twist in said strand as said strand is being forwarded to said take-up mechanism; the improvement comprising a pneumatic false twister disposed between said nip rolls and said take-up mechanism for providing twist in said strand in the same direction as the rotational direction of said spindle.

8. The spinning frame position of claim 7 wherein said twister is disposed at a distance of from about 5 to 15 cm from said nip rolls.

9. The spinning frame position of claim 8 wherein said twister serves as the sole guide between said nip rolls and said take-up mechanism.

* * * * *